United States Patent [19]

Cone

[11] Patent Number: 4,848,855

[45] Date of Patent: Jul. 18, 1989

[54] ACCESSORY STORAGE DEVICE HAVING MODULAR CONSTRUCTION

[75] Inventor: Robert L. Cone, Elverson, Pa.

[73] Assignee: Buckler Corporation, Elverson, Pa.

[21] Appl. No.: 73,124

[22] Filed: Jul. 13, 1987

[51] Int. Cl.[4] ..... A47B 77/00

[52] U.S. Cl. ..... 312/107; 211/13; 211/87; 248/309.2

[58] Field of Search ..... 312/140.4, 107, 245, 312/290, 111; 211/87, 13; 248/309.2

[56] References Cited

U.S. PATENT DOCUMENTS

| | | | |
|---|---|---|---|
| D. 30,492 | 4/1899 | Briggs . | |
| D. 35,734 | 2/1902 | Scheer . | |
| D. 36,744 | 1/1904 | Vernon . | |
| D. 38,665 | 7/1907 | Briggs . | |
| D. 41,192 | 2/1911 | Hanna . | |
| D. 59,967 | 12/1921 | Jurek . | |
| D. 71,152 | 9/1926 | McLeod . | |
| D. 98,097 | 1/1936 | Swanson . | |
| D. 102,424 | 12/1936 | Gardiner . | |
| 114,418 | 5/1871 | Dapron . | |
| D. 135,205 | 3/1943 | McCowan . | |
| D. 141,376 | 5/1945 | Miller . | |
| D. 149,763 | 5/1948 | Ketchum, Jr. . | |
| D. 150,241 | 7/1948 | Main . | |
| D. 150,377 | 7/1948 | Spence . | |
| D. 162,472 | 3/1951 | Roth . | |
| D. 176,404 | 12/1955 | Carr . | |
| D. 187,537 | 3/1960 | Gosecky . | |
| D. 190,031 | 4/1961 | Bouchard . | |
| 194,703 | 8/1977 | Mayo et al. | 312/245 X |
| D. 214,408 | 6/1969 | Pintea . | |
| D. 224,492 | 8/1972 | Inhelder . | |
| D. 234,981 | 4/1975 | Walsh . | |
| 715,563 | 12/1902 | Doublat . | |
| 1,356,014 | 10/1920 | Reed . | |
| 1,747,480 | 2/1930 | Newell . | |
| 1,949,326 | 2/1934 | Peterson | 312/107 X |
| 2,066,478 | 1/1937 | Lewin | 211/13 X |
| 2,175,753 | 10/1939 | Guthmann . | |
| 2,409,117 | 10/1946 | Fero | 312/107 |
| 2,450,337 | 9/1948 | Hearst . | |
| 2,521,572 | 9/1950 | Eckel et al. | 312/245 |
| 2,627,982 | 2/1953 | Williams . | |
| 2,738,250 | 3/1956 | Mele et al. . | |
| 2,867,048 | 1/1959 | Holtzman . | |
| 3,030,163 | 4/1962 | Gottsegen | 312/111 |
| 3,318,647 | 5/1967 | Bishop . | |
| 3,741,617 | 6/1977 | Gloyd | 312/111 X |
| 3,924,735 | 12/1975 | Gonzalez . | |
| 3,930,702 | 1/1976 | Pichowicz . | |
| 3,997,219 | 12/1976 | Phelps . | |
| 4,088,380 | 5/1978 | Watts . | |
| 4,141,612 | 2/1979 | Rowe | 312/245 |
| 4,209,212 | 6/1980 | McGoldrick . | |
| 4,216,858 | 8/1980 | Beauchamp . | |
| 4,231,626 | 11/1980 | Amtmann et al. | 312/320 X |
| 4,324,446 | 4/1982 | LeSage . | |
| 4,413,736 | 11/1983 | Nibling . | |
| 4,546,888 | 10/1985 | Rosberg et al. . | |
| 4,573,585 | 3/1986 | Frei . | |
| 4,586,759 | 5/1986 | Wrobel | 312/107 X |
| 4,666,150 | 5/1987 | Segrist | 211/13 |

*Primary Examiner*—Joseph Falk

*Attorney, Agent, or Firm*—Panitch Schwarze Jacobs and Nadel

[57] ABSTRACT

An accessory storage device having a modular construction comprising discrete drawer housing units attachable in a horizontal row. Each drawer housing unit contains one or more drawers slidably mounted within and may be hung on a substantially flat vertical surface or supported on a substantially flat horizontal surface. One or more storage units, each having spaced wall portions defining one or more open compartments are attachable to the top wall of each drawer housing unit. In another embodiment, one or more storage units each having a pivotable cover are attachable to the top wall of each drawer housing unit. A discrete unit for hanging accessories is removably attachable to the bottom wall of each drawer housing unit when the drawer housing units are wall mounted. The unit for hanging accessories is also removably attachable to the open compartment storge units, so as to be spaced in elevation above the storage units, by means of one or more dowel-type posts when the drawer housing units are supported on a substantially flat horizontal surface. The various units can be assembled in a variety of configurations to provide the type of storage required by the user.

14 Claims, 5 Drawing Sheets

ACCESSORY STORAGE DEVICE HAVING MODULAR CONSTRUCTION

BACKGROUND OF THE INVENTION

The invention is directed to an accessory storage device for jewelry or the like. A discrete drawer housing unit is provided with a vertical bank of slidable drawers for storing objects such as rings, earrings, brooch pins and the like. A discrete storage unit having open compartments is provided for storing larger sized objects such as bangle bracelets and the like. Another discrete unit is provided for hanging accessories such as chains and necklaces. Each discrete unit is a module, and the modules may be assembled together in a variety of configurations. The entire assembly may be wall mounted or mounted on a dresser top.

BRIEF SUMMARY OF THE INVENTION

An accessory storage device having a modular construction comprising a drawer housing unit and one or more drawers slidably mounted in the drawer housing unit. Means are disposed along the drawer housing unit rear wall for mounting the drawer housing unit on a substantially flat vertical surface. A storage unit having spaced upstanding wall portions defining one or more open compartments for storing accessories therein is adapted to be mounted on the drawer housing unit top wall. A unit is provided with means for hanging accessories thereon, and the last-mentioned unit and the drawer housing unit bottom wall are provided with structure for attaching one to the other. Means are provided for attaching the storage unit to the unit having means for hanging accessories such that the last-mentioned unit is spaced in elevation above the storage unit.

For the purpose of illustrating the invention, there are shown in the drawings forms which are presently preferred; it being understood, however, that this invention is not limited to the precise arrangements and instrumentalities shown.

DETAILED DESCRIPTION OF INVENTION

Figure 1:
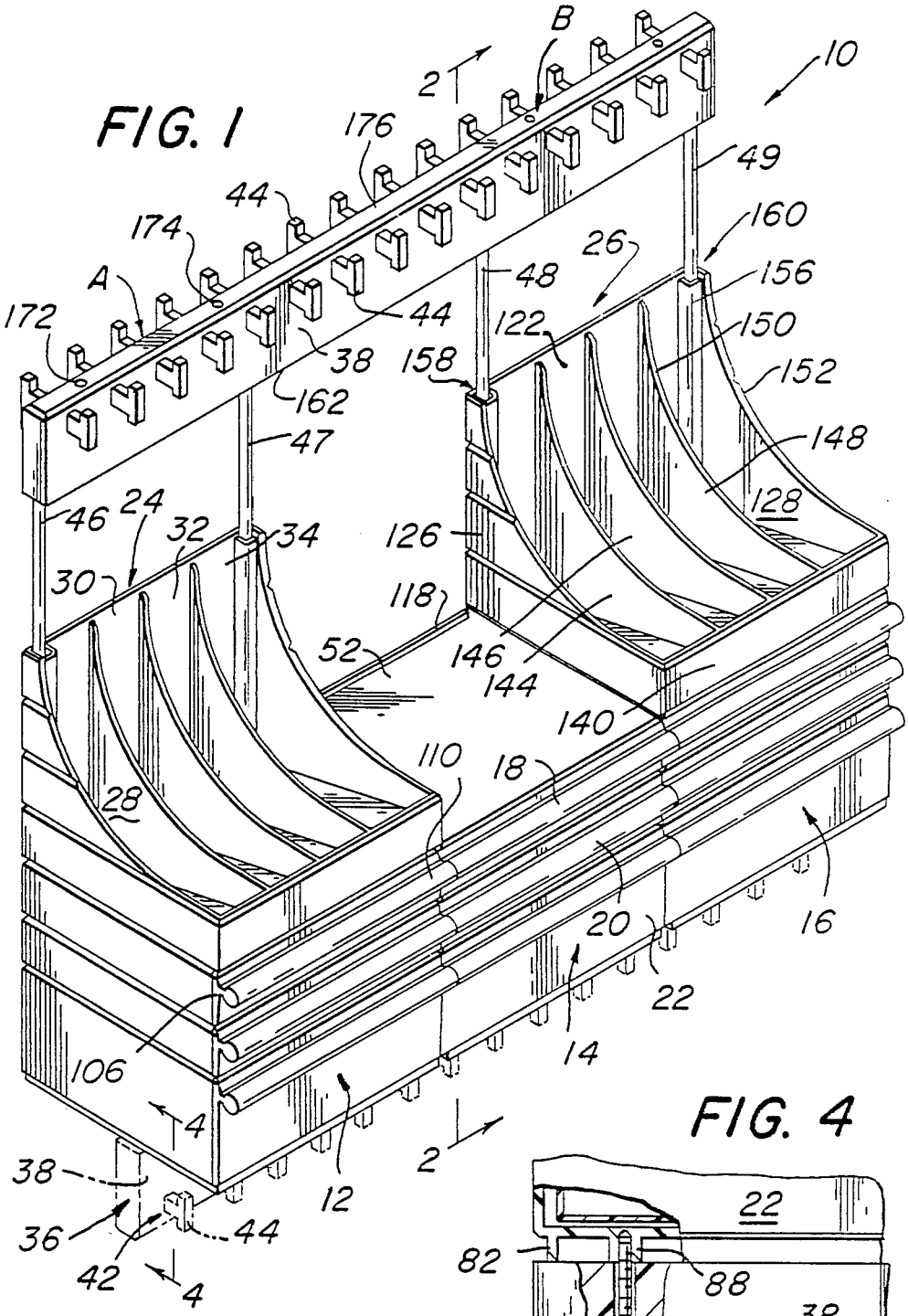
FIG. 1 is an isometric of an accessory storage device the present invention.

Referring to the drawings, wherein like numerals indicate like elements, there is shown in FIG. 1 a particular assembly 10 of discrete modular units according to the present invention. Assembly 10 includes a horizontal row of discrete modular drawer housing units 12, 14, 16. Each drawer housing unit is provided with a vertical bank of drawers 18, 20, 22. Each drawer is slidably mounted inside its housing unit.

Discrete, modular storage units 24, 26 are mounted atop drawer housing units 12, 16 respectively. Each storage unit 24, 26 is provided with a horizontal row of adjoining open compartments 28, 30, 32, 34. Each storage unit (24, 26) can be mounted atop any one of the drawer housing units 12–16. Any number of housing units can be attached together, along facing side walls, by adhesive or the like to provide a horizontal row of varying numbers of drawer housing units as shown in FIG. 1. Smaller sized objects such as rings, earrings, brooch pins and the like may be stored in the drawers 18–22. Larger sized objects such as bangle bracelets and the like may be stored in the open compartments 28–34 of each storage unit 24, 26.

A discrete, modular unit 36 for hanging accessories such as chains and necklaces is removably attachable to the bottom structure of endmost drawer housing units 12, 16. Unit 36 is preferably in the form of an elongated panel 38 having horizontal rows 40, 42 of spaced hook-like projections 44, one row on opposite sides of the panel. The panel is also removably attachable to the storage units 24, 26 by identical dowel-type posts 46, 47, 48, 49 whereby the panel is spaced in elevation above the storage units. When assembly 10 is wall mounted, panel 38 is attached to the bottom structure of the endmost drawer housing units 12, 16 such that both rows 40, 42 of hook-like projections are spaced outwardly from the wall and available for use. When assembly 10 is mounted on a dresser top, panel 38 is mounted on dowel posts 46–49 both rows 40, 42 of hook-like projections again being available for use.

Each drawer housing unit 12–16 is provided with a rear wall 50, a top wall 52, a bottom wall 54 and side walls 56, 58. Walls 50–58 are connected along their edges to provide a unitary structure. The outer surface of each side wall 56, 58 is provided with a pair of ornamental grooves 60, 62. The inside surface of each side wall 56, 58 is provided with a horizontally extending rib 64 spaced in elevation from the inside surface of top wall 52, a pair of horizontally extending spaced ribs 66, 68 proximal the elevation of groove 60, and a pair of horizontally extending spaced ribs 70, 72 proximal the elevation of groove 62. The spacing in elevation between rib 64 and ribs 66, 68, and between ribs 66, 68 and ribs 70, 72, is approximately the same although it can vary according to the vertical depth of the drawers 18, 20. The spacing between ribs 70, 72 and the inside surface of bottom wall 54 is determined by the vertical depth of drawer 22.

Figure 3:
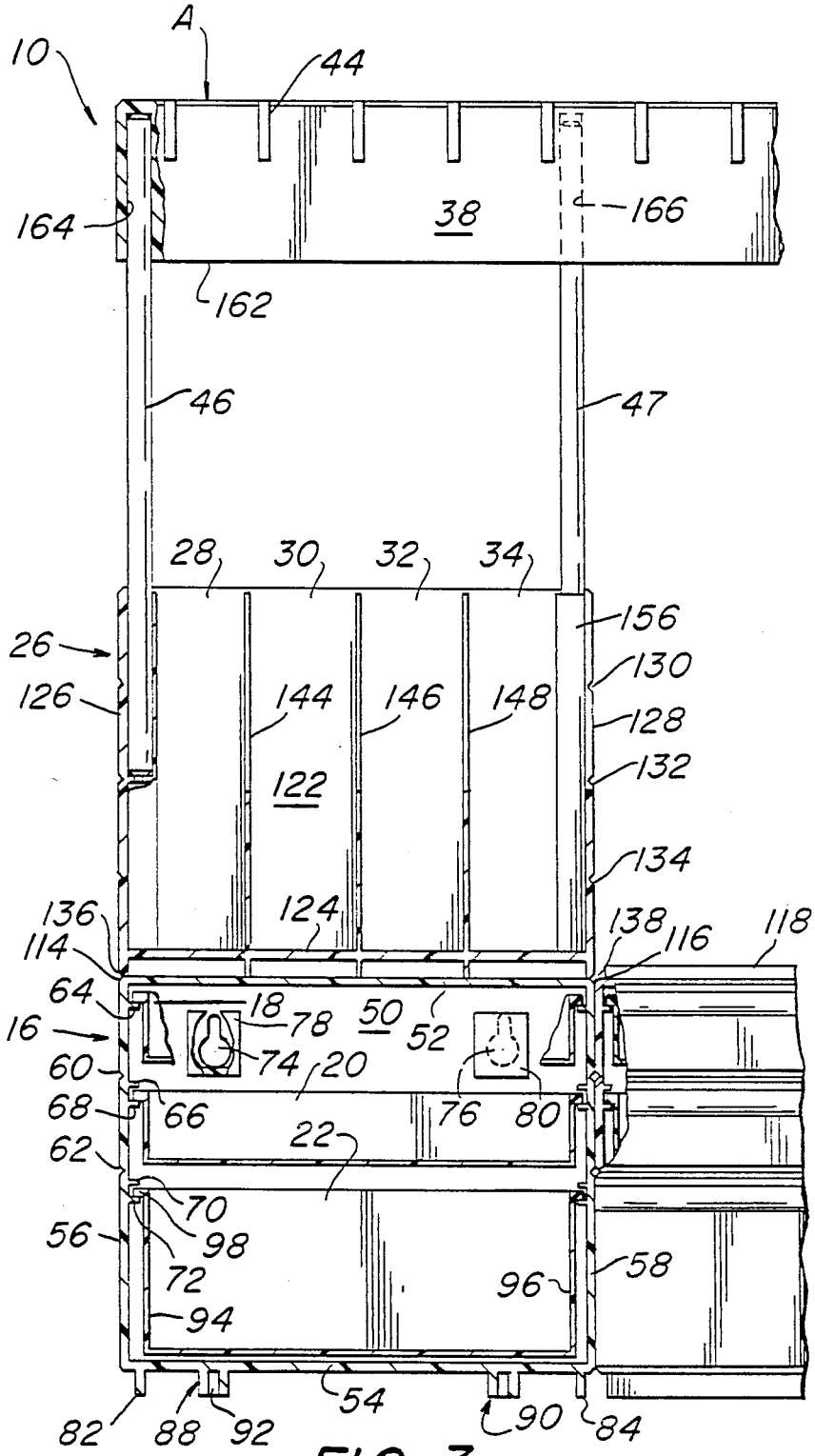
FIG. 3 is a section taken along 3—3 in FIG. 2.

A pair of openings or eyelets 74, 76 are formed in rear wall 50 to enable the drawer housing unit to be mounted on screws fastened to a vertical wall surface (FIG. 3). A pair of covering blocks 78, 80 are secured to the inside surface of rear wall 50 so as to conceal openings 74, 76 from the inside of the drawer housing unit. The outer surface of bottom wall 54 is provided with ribs 82, 84, 86 which support the drawer housing unit on a substantially flat surface such as a dresser top. The outer surface of bottom wall 54 is also provided with a pair of spaced cylindrical shaped projections 88, 90. Each projection is provided with a tap hole 92 for receiving a threaded fastener such as a screw to mount panel 38 as described in further detail below.

Each drawer 18–22 is provided with a pair of side walls 94, 96. Each side wall 94, 96 is provided with a laterally projecting rib or lip 98 along its top edge. Each lip on the side walls of drawer 18 is slidably received in the space between the inside surface of top wall 52 and the ribs 64 on the inside surface of each drawer housing unit side wall 56, 58. Each lip on the side walls of drawer 20 is slidably received in the space between the pair of ribs 66, 68 on the inside surface of each drawer housing unit side wall 56, 58. Each lip on the side walls of drawers 22 is slidably received in the space between the pair of ribs 70, 72 on the inside surface of drawer housing unit side walls 56, 58. Thus, each drawer 18, 20, 22 is slidably mounted within the drawer housing unit.

Each drawer is provided with a front wall 100 having chamfered upper and lower edges 102, 104. The front wall 100 of drawer 18 extends vertically above the elevation of the side wall lips 98 so that the upper edge 102 is substantially flush with the outer surface of top wall 52. The width of the drawer front wall 100 is such that each drawer front wall side edge 106 is substantially flush with the outer surface of one of drawer housing unit side walls 56, 58.

Each drawer front wall 100 is also provided with a horizontally extending handle member 110. Preferably, the handle member extends across the full width of the drawer front wall. The handle member has a generally cylindrical shaped portion 112 spaced outwardly from the front wall. The cylindrical shaped portion 112 may be gripped between the thumb and forefinger to draw the drawer outwardly from the drawer housing unit. The side edges 114, 116 of the drawer housing unit top wall 52 may be chamfered to provide a desired ornamental appearance. A horizontally extending rib 118 is provided on the outer surface of the top wall 52 proximal the top edge of rear wall 50 for locating storage unit 24 or 26 on the top wall as described in further detail below.

Each storage unit 24, 26 is provided with a rear wall 122, a bottom wall 124 and a pair of end or side walls 126, 128. The outer surface of each end wall is provided with a triplet of spaced grooves 130, 132, 134 which match the drawer housing unit grooves 60, 62 for the sake of ornamental appearance. The bottom edges 136, 138 of storage unit end walls 126, 128 are chamfered as are the top edges 114, 116 of drawer housing unit top wall 52 so as to simulate a groove matching grooves 130–134 and 60–62 when the storage unit 24 or 26 is mounted atop the drawer housing unit 12, 14 or 16. Each storage unit 24, 26 is also provided with a front wall 140 having a height substantially less than that of storage unit rear wall 122. The bottom edge 142 of storage unit front wall 140 is chamfered so as to simulate, together with the chamfered upper edge 102 of the front wall 100 of drawer 18, a groove matching grooves 130–134 and 60, 62 when the storage unit is mounted on the drawer housing unit. Similarly, the chamfered upper and lower edges 102, 104 of vertically adjacent drawer front walls define a groove matching grooves 60, 62 when the drawers are closed.

Figure 2:
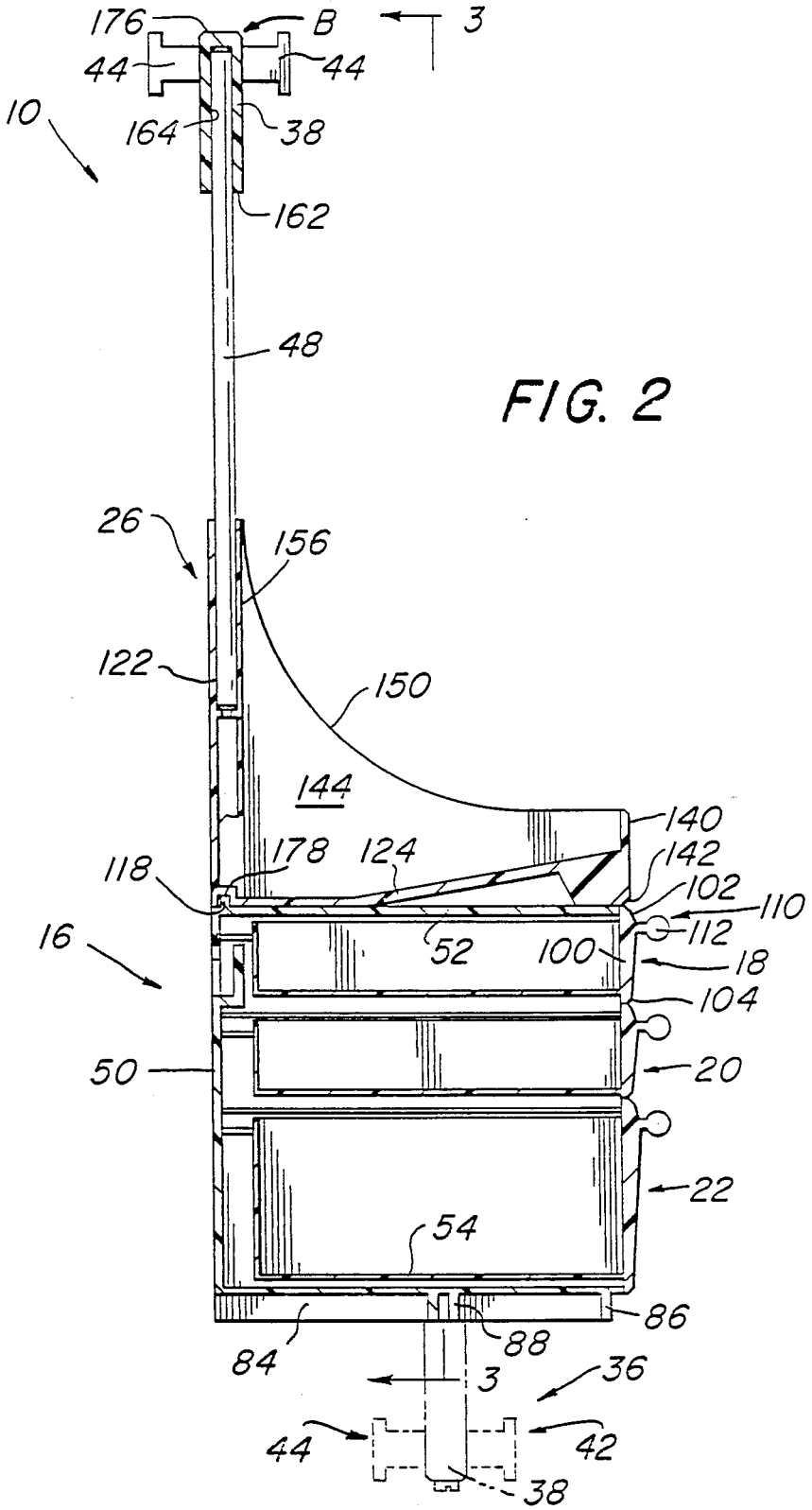
FIG. 2 is a section taken along 2—2 in FIG. 1.

Each storage unit 24, 26 is provided with a set of spaced partitions 144, 146, 148 connected to rear wall 122, bottom wall 124 and front wall 140. Each of partitions 144–148 is provided with an arcuate edge 150. Each of end walls 126, 128 is provided with a matching arcuate edge 152. End walls 126, 128 and partitions 144–148 define open compartments 28, 30, 32, 34 within which larger sized objects such as bangle bracelets may be stored. Preferably, at least a portion of the upper surface of bottom wall 124 is inclined with respect to the horizontal so that an object stored in a compartment will slide or roll by gravity to a stable storage position against rear wall 122 (FIG. 2).

A vertically extending bracket 156 is formed or secured in place at each corner 158, 160 formed by rear wall 122 and end walls 126, 128. Each bracket 156 is sized and positioned so as to define a passage for slidably receiving one of the dowel-type posts 46–49. The dowel-type posts are inserted in the receptacles defined by the corner brackets when the assembly 10 is supported on a substantially flat surface such as a dresser top. The dowel-type posts provide the support structure for the panel 38 in this configuration.

Figure 4:
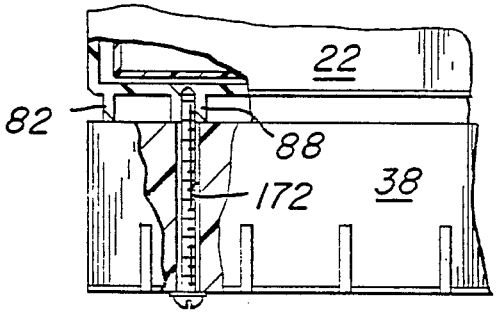
FIG. 4 a partial section taken along 4—4 in FIG. 1.

Each end portion A, B of panel 38 is provided with a pair of spaced passages 164, 166 which are open at panel surface 162 and extend within the panel but not through it. Each passage slidably and snugly receives an end of one dowel-type post. The other end of the dowel-type post is received in the corner receptacle of the storage unit (FIG. 3). When the panel 38 is mounted on the dowel-type posts, it is spaced in elevation above the storage units 24, 26. Chains, necklaces and like accessories can be hung from the hook-like projections 44 on opposite sides of the panel (FIG. 2). Each end portion A, B of panel 38 is also provided with a pair of spaced, relatively narrow diameter, passages 172, 174, each passage extending through the panel from surface 162 to surface 176 so as to provide a through hole for passage of a screw type fastener. Thus, when the assembly 10 is wall mounted, panel 38 is removably attached to the bottom structure of drawer housing units 12, 16 by the screw fasteners (not numbered), each of which extends through one of the passages 172, 174 into one of the bottom wall projections 88, 90 of a drawer housing unit. See FIG. 4. The projections 88, 90 on each drawer housing unit are spaced from the rear wall 50 of the unit such that the row of hook-like projections 44 (on panel 38) facing the mounting wall surface (not shown) are spaced from the mounting wall surface by a sufficient distance to enable accessories to be conveniently hung from the hook-like projections. Thus, in the present invention, panel 38 is invertible so as to be removably attachable to the assembly, above or below the drawer housing units, depending on whether the assembly is mounted on a vertical wall surface or supported on a dresser top or similar flat horizontal surface.

The bottom wall 124 of each storage unit 24, 26 is provided with a slot 178 proximal its rear wall 122. Slot 178 is sized so as to receive the rib 118 on the drawer housing unit top wall 52. Thus, slot 178 and rib 118 serve as mating structure for locating a storage unit 24 or 26 on a drawer housing unit 12, 14 or 16. The storage unit may also be secured permanently to the drawer housing unit by adhesive or the like applied between the storage unit bottom wall 124 and the drawer housing unit top wall 52.

In use, the desired number of drawer housing units is selected, and the drawer housing units are secured together by adhesive applied between facing vertical side walls of the units. The desired number of storage units is then selected, and the storage units are mounted on and secured to the tops of the drawer housing units in any desired arrangement. In the arrangement shown in FIG. 1, the storage units are positioned on the endmost drawer housing units only but the invention is not limited to the particular arrangement shown. If the assembly is to be mounted on a dresser top or other horizontal support surface, the dowel posts are inserted in the storage unit receptacles, and the panel 38 is mounted on the dowel posts. In this regard, it should be appreciated that panels (38) having any desired length may be utilized although in the embodiment described herein, it is preferred that the length of a panel span the entire row of drawer housing units. If the assembly is to be wall mounted, the panel 38 is secured by screw fasteners to the bottom structure (projections 88, 90) of each end-most drawer housing unit. The entire assembly may then be mounted on screw fasteners secured to the mounting wall surface, the heads of the screw fasteners being received in the eyelets 74, 76 formed in the drawer housing unit rear walls.

Figure 5:
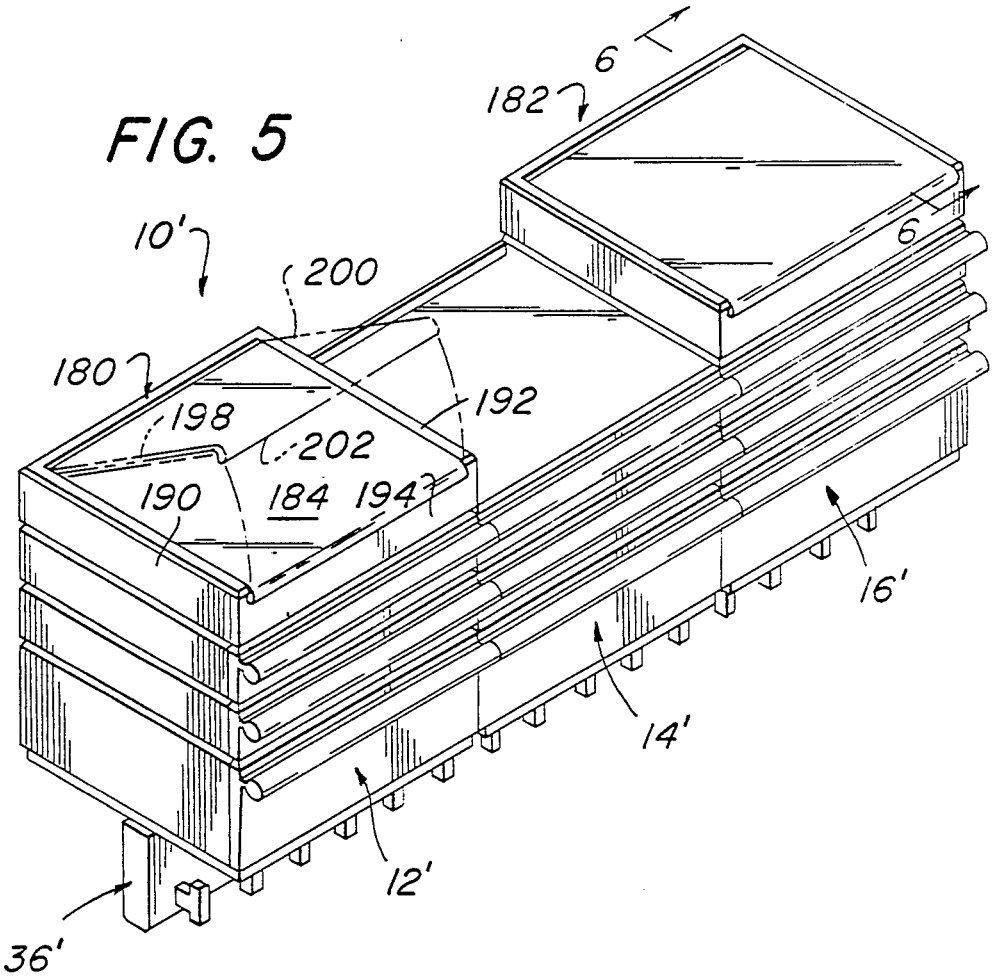
FIG. 5 is an isometric of an alternate embodiment of the device of the present invention.
Figure 6:
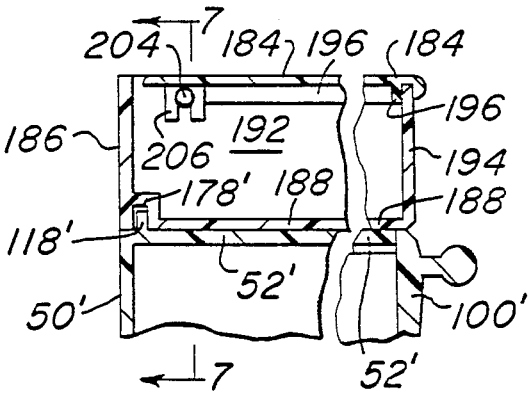
FIG. 6 is a partial section taken along 6—6 in FIG. 5.
Figure 7:
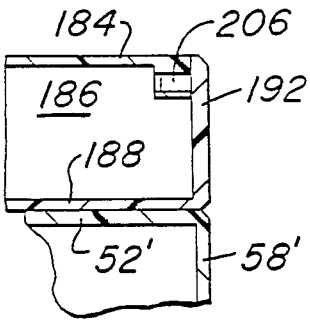
FIG. 7 is a partial section taken along 7—7 in FIG. 6.

An alternative embodiment of the invention 10' is shown in FIGS. 5–7. In this embodiment of the invention, a discrete, modular unit 36' for hanging accessories is attached to the bottom walls of drawer housing units 12', 16' as previously described. Discrete, modular storage units 180, 182 are mounted atop drawer housing 12', 16', respectively. Each storage unit 180, 182 is provided with a pivotable cover 184 which can be swung between closed and open positions. The closed position is shown in solid lines in FIG. 5. The open position is shown in broken lines in FIG. 5. Each storage unit (180, 182) can be mounted atop any one of the drawer housing units 12'–16'. Any number of drawer housing units can be attached together, along facing side walls as previously described.

Each storage unit 180, 182 is provided with a rear wall 186, a bottom wall 188, and a pair of end or side walls 190, 192. Each storage unit 180, 182 is also provided with a front wall 194 having a height slightly less than that of side walls 190, 192. The pivotable cover 184 is provided with a rib 196 which is inset from and extends parallel to each cover side edge 198, 200 and the cover front edge 202. When the cover 184 is in the closed position, the bottom front edge of the cover rests on the storage unit front wall 194. See FIG. 6.

A pivot post 204 projects inwardly from side wall 190. A like pivot post (not shown) projects inwardly from side wall 192. A pair of double leg snap fasteners (only one of which designated 206 is shown) depend from the bottom, rear corner portions of cover 184 so as to snap fasten the cover on each pivot post 204. The cover 184 is pivotably mounted on the pivot posts with the rear edge of the cover being spaced from the storage unit rear wall 186. Accordingly, the cover is free to pivot without obstruction about the longitudinal axes of the pivot posts.

The storage unit bottom wall 188 is provided with a slot 178' for receiving a rib 118' on the drawer housing top unit top wall 52' whereby the storage unit may be located atop the drawer housing unit. The storage unit may also be secured permanently to the drawer housing unit by adhesive or the like applied between the storage unit bottom wall 188 and the drawer housing unit top wall 52'.

Figure 8:
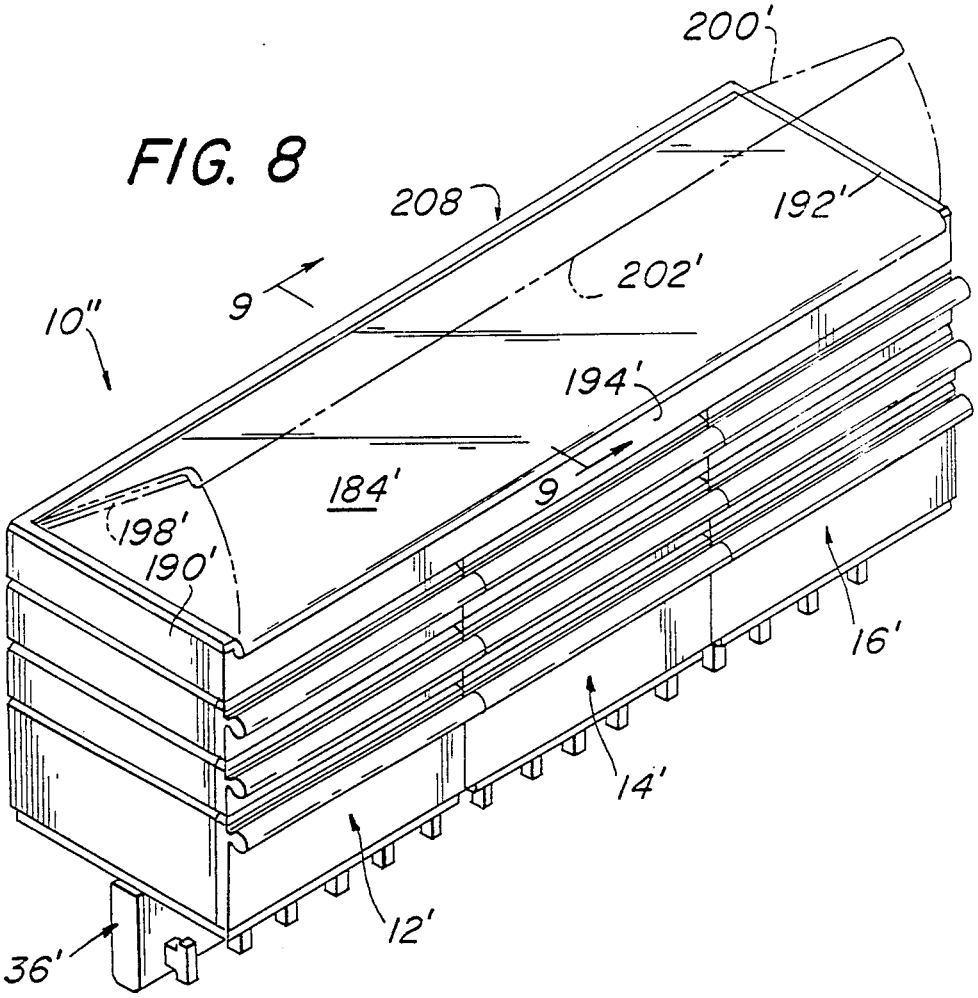
FIG. 8 is an isometric of a further embodiment of the accessory device of the present invention.
Figure 9:
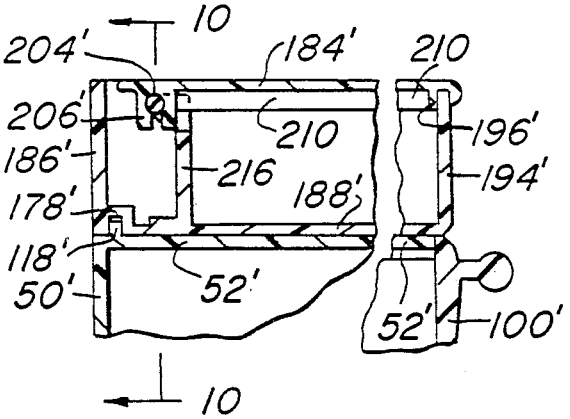
FIG. 9 is a partial section taken along 9—9 in FIG. 8.
Figure 10:
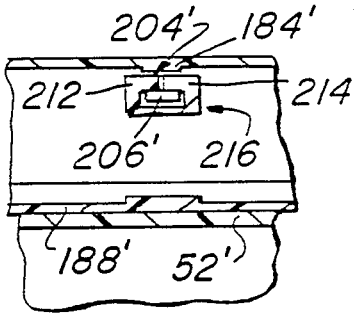
FIG. 10 is a partial section taken along 10—10 in FIG. 9.

A further embodiment 10'' of the invention is shown in FIGS. 8–10. In this embodiment of the invention, a discrete, modular storage unit 208 is mounted atop drawer housing units 12'–16'. The storage unit 208 is provided with a rear wall 186', a bottom wall 188' and a pair of end or side walls 190', 192'. The storage unit is also provided with a front wall 194' having a height slightly less than that of side walls 190', 192'.

Storage unit 208 includes a pivotable cover 184' which can be swung between closed and open positions. The closed position is shown in solid lines in FIG. 8. The open position is shown in broken lines in FIG. 8. The cover includes a depending rib 196' which is inset from and extends parallel to each side edge 198', 200' and the front edge 202' of the cover. When the cover is in the closed position, the bottom front edge of the cover rests on the storage unit front wall 194'. See FIG. 9.

The cover 184' is provided with a depending rib 210 which extends parallel to the cover side edges 198', 200' mid-way between the side edges. The rib 210 terminates in a double-legged snap fastener 206' by which the cover is pivotably mounted on a pivot post 204'. The pivot post 204' is formed by two inwardly projecting legs 212, 214 of a clevis 216 which extends upwardly form the storage unit bottom wall 188'. See FIGS. 9 and 10. The snap fastener 206' is pivotably mounted on the pivot post 204' such that the rear edge of the cover is spaced from the storage unit rear wall 186' to permit unobstructed pivoting motion of the cover.

The bottom wall 188' of the storage unit is provided with a slot 178' proximal its rear wall 186'. Slot 178' is sized so as to receive a rib 118' on a drawer housing unit top wall 52' whereby the storage unit may be located on the drawer housing units 12'–16'. The storage unit may also be secured permanently to the drawer housing units by adhesive or the like applied between the storage unit bottom wall 188' and the drawer housing unit top walls 52'.

Preferably, each of the units described herein is made of a lightweight, rigid polymeric plastic material. The simplicity of structure allows each unit to be manufactured inexpensively. By using discrete, modular units, a variety of configurations or combinations of the units is made possible. When the desired configuration is selected, the units may be permanently secured together by adhesive or the like to present a unified, robust structure. The unified assembly may be wall mounted or mounted on a dresser top, and accessories may be hung on the assembly in either case.

The present invention may be embodied in other specific forms without departing from the spirit or essential attributes thereof and, accordingly, reference should be made to the appended claims, rather than to the foregoing specification, as indicating the scope of the invention.

I claim:

1. Accessory storage device having modular construction, comprising:

discrete, lightweight drawer housing and storage units, the drawer housing unit having one or more drawers slideably mounted in said drawer housing unit, the drawer housing unit having a rear wall and a top wall, means disposed along the drawer housing unit rear wall for mounting the drawer housing unit on a substantially flat vertical surface, the storage unit having spaced upstanding wall portions defining one or more open compartments for storing accessories therein, said storage unit being adapted to be mounted on the drawer housing unit top wall, said drawer housing unit including a bottom wall, a discrete, lightweight accessory hanger unit provided with means for hanging accessories thereon, said last-mentioned unit and the drawer housing unit bottom wall having means for attaching one to the other such that said accessory hanger unit depends from said bottom wall, and means for attaching said storage unit to said accessory hanger unit such that said last-mentioned unit is spaced in elevation above said storage unit.

2. Accessory storage device according to claim 1 wherein said means for attaching said storage unit to said accessory hanger unit includes a support post, and wherein the storage unit is adapted to receive said support post at one end thereof and said accessory hanger unit is adapted to receive said support post at an opposite end thereof.

3. Accessory storage device having modular construction, comprising:

discrete, lightweight drawer housing and accessory hanger units, the drawer housing unit having one or more drawers slideably mounted in said drawer housing unit, the housing unit having a rear wall and a bottom wall, means disposed along said drawer housing unit rear wall for mounting the drawer housing unit on a substantially flat vertical surface, the accessory hanger unit being provided with means for hanging accessories thereon, said last-mentioned unit and the drawer housing unit bottom wall having means for attaching one to the other such that said accessory hanger unit depends from said bottom wall, a storage unit adapted to be mounted on the drawer housing unit, and means for attaching said storage unit to said accessory hanger unit such that said last-mentioned unit is spaced in elevation above said storage unit.

4. Accessory storage device according to claim 3 wherein said drawer housing unit includes a top wall, and further comprising a discrete, lightweight storage unit having spaced upstanding wall portions defining one or more open compartments for storing accessories therein, said storage unit being adapted to be mounted on the drawer housing unit top wall.

5. Accessory storage device having modular construction, comprising:

discrete, lightweight drawer housing and storage units, the drawer housing unit having one or more drawers slideably mounted in said drawer housing unit, the drawer housing unit having a top wall and a bottom wall, the storage unit having spaced upstanding wall portions defined by one or more open compartments for storing accessories therein, said storage unit being adapted to be mounted on the drawer housing unit top wall, a discrete, lightweight accessory hanger unit provided with means for hanging accessories thereon, said last-mentioned unit and the drawer housing unit bottom wall having means for attaching one to the other such that said accessory hanger unit depends from said bottom wall, and means for attaching said storage unit to said accessory hanger unit such that said last-mentioned unit is spaced in elevation above said storage unit.

6. Accessory storage device according to claim 5 wherein said drawer housing unit includes a rear wall, and means disposed along the drawer housing unit rear wall for mounting the drawer housing unit on a substantially flat vertical surface.

7. Accessory storage device according to claims 1 or 5 wherein the drawer housing unit top wall and the storage unit are provided with structure for locating the storage unit on the drawer housing unit top wall.

8. Accessory storage device according to claims 1, 3 or 6 wherein said means for mounting the drawer housing unit includes one or more openings in the housing unit rear wall whereby said housing unit may be hung on members projecting from said substantially flat vertical surface.

9. Accessory storage device according to claim 8 wherein said drawer housing unit includes means located inside the drawer housing unit includes means located inside the drawer housing unit for covering said one or more openings.

10. Accessory storage device according to claims 1, 3 or 5 wherein the drawer housing unit bottom wall is provided with support means for supporting the housing unit on a substantially flat horizontal surface.

11. Accessory storage device according to claims 1, 3 or 5 wherein a drawer is provided with a substantially flat front wall and a handle member extending substantially across the full width of said drawer front wall.

12. Accessory storage device having modular construction, comprising:

discrete, lightweight drawer housing and storage units, the drawer housing unit having one or more drawers slideably mounted in said drawer housing unit, the drawer housing unit having a top wall, the storage unit having a compartment for storing accessories therein and adapted to be mounted on the drawer housing unit top wall, said storage unit including a cover moveable between open and closed positions whereby said compartment may be opened and closed, said drawer housing unit including a rear wall, and means disposed along the drawer housing unit rear wall for mounting the housing unit on a substantially vertical surface, said drawer housing unit including a bottom wall, a discrete, lightweight accessory hanger unit provided with means for hanging accessories thereon, said last-mentioned unit and the drawer housing unit bottom wall having means for attaching one to the other such that said accessory hanger unit depends from said bottom wall, and means for attaching said storage unit to said accessory hanger unit such that said last-mentioned unit is spaced in elevation above said storage unit.

13. Accessory storage device according to claim 12 wherein the drawer housing unit top wall and the storage unit are provided with structure for locating the storage unit on the drawer housing unit top wall.

14. Accessory storage device according to claim 12 wherein said cover is pivotable between said open and closed positions.

* * * * *